US007485029B2

(12) United States Patent
Kanda et al.

(10) Patent No.: US 7,485,029 B2
(45) Date of Patent: Feb. 3, 2009

(54) DOUBLE FACE POLISHING APPARATUS

(75) Inventors: Satoki Kanda, Nagano (JP); Harumichi Koyama, Nagano (JP); Masahiro Takeuchi, Nagano (JP); Yoichi Morozumi, Nagano (JP)

(73) Assignee: Fujikoshi Machinery Corp., Nagano-Shi, Nagano (JP)

( * ) Notice: Subject to any disclaimer, the term of this patent is extended or adjusted under 35 U.S.C. 154(b) by 0 days.

(21) Appl. No.: 11/882,999

(22) Filed: Aug. 8, 2007

(65) Prior Publication Data

US 2008/0057831 A1 Mar. 6, 2008

(30) Foreign Application Priority Data

Sep. 1, 2006 (JP) ..... 2006-237830

(51) Int. Cl.
*B24B 7/00* (2006.01)
*B24B 9/00* (2006.01)
*B24B 57/02* (2006.01)

(52) U.S. Cl. ..... 451/267; 451/7; 451/262; 451/268; 451/446

(58) Field of Classification Search ..... 451/7, 451/60, 261, 262, 264, 267, 268, 269, 446
See application file for complete search history.

(56) References Cited

U.S. PATENT DOCUMENTS

| | | | | |
|---|---|---|---|---|
| 5,803,798 | A | 9/1998 | Cesna et al. | |
| 6,045,437 | A | 4/2000 | Tandon et al. | |
| 6,113,478 | A * | 9/2000 | Anderson et al. | 451/262 |
| 2002/0056548 | A1 | 5/2002 | Nakamura et al. | |

FOREIGN PATENT DOCUMENTS

| | | | |
|---|---|---|---|
| JP | 11-262862 | A | 9/1999 |

* cited by examiner

*Primary Examiner*—Timothy V Eley
(74) *Attorney, Agent, or Firm*—Birch, Stewart, Kolasch & Birch, LLP

(57) ABSTRACT

The double face polishing apparatus is capable of controlling an amount of supplying slurry to a lower polishing plate. The double face polishing apparatus comprises: a lower polishing plate and an upper polishing plate; a carrier provided between the polishing plates, the carrier having a through-hole for holding a workpiece; a plate driving unit for rotating the polishing plates; a carrier driving unit for rotating the carrier; ring-shaped ducts coaxially provided to the upper polishing plate; a slurry supply source supplying slurry to the ring-shaped ducts; and supply pipes for supplying the slurry to the lower polishing plate. The slurry is supplied to each of coaxial polishing zones of the lower polishing plate via the corresponding ring-shaped ducts and the supply pipes.

6 Claims, 4 Drawing Sheets

DOUBLE FACE POLISHING APPARATUS

BACKGROUND OF THE INVENTION

The present invention relates to a double face polishing apparatus capable of polishing both faces of a workpiece, e.g., silicon wafer.

A conventional double face polishing apparatus is disclosed in Japanese Patent Kokai Gazette No. 11-262862. In the apparatus, workpieces, e.g., silicon wafers, are clamped between an upper polishing plate and a lower polishing plate, and the polishing plates are rotated with supplying slurry to a polishing face of the lower polishing plate, so that both faces of the workpieces can be mechanically and chemically polished.

The conventional apparatus is shown in FIG. 6. The apparatus has a lower polishing plate 10, whose upper face acts as a polishing face, and an upper polishing plate 14, whose lower face acts as a polishing face and which is provided above the lower polishing plate 10 and can be vertically moved by a cylinder unit 12. The polishing plates 10 and 14 are rotated, about their own axes, in the opposite directions by a driving unit.

A carrier (not shown) having through-holes, in each of which the workpiece is held, is provided between the polishing plates 10 and 14. The carrier is rotated and orbited by a sun gear (not shown) and an internal gear (not shown). A ring-shaped duct 18, to which slurry is supplied from a slurry supply source 16, is provided to the upper polishing plate 14. A plurality of supply pipes 20 communicate slurry supply holes of the ring-shaped duct 18 to slurry supply holes 22 of the upper polishing plate 14 so as to supply the slurry to the lower polishing plate 10 via the supply pipes 20.

By supplying the slurry to the polishing face of the lower polishing plate 10, the workpieces can be mechanically and chemically polished. Preferably, the slurry is uniformly supplied to the lower polishing plate 10. Conventionally, the slurry supply holes 22 of the upper polishing plate 14 are radially arranged.

The slurry supplied onto the lower polishing plate 10 from the slurry supply holes 22, which are located an inner part of the upper polishing plate 14, is moved toward an outer part of the lower polishing plate 10 by a centrifugal force caused by rotation of the lower polishing plate 10. The slurry supply holes 22 are sparsely provided in the outer part of the lower polishing plate 10, but the slurry is moved from the inner part to the outer part, so that the slurry can be relatively uniformly supplied to the lower polishing plate 10.

However, in the above described conventional apparatus, an amount of the slurry to be supplied cannot be controlled. As shown in FIG. 6, lengths of the supply pipes 20 are not fixed. In the long pipes 20, flow resistance is great, and mid parts of the pipes are bent downward by their weights. Therefore, the slurry is apt to stay therein and cannot be smoothly supplied. On the other hand, in the short pipes 20, flow resistance is small and no slurry stays therein, so that the slurry can be smoothly supplied. Since the lengths of the supply pipes 20 are different, it is difficult to control the amount of the slurry.

In another conventional polishing apparatus, electromagnetic valves are respectively provided to the supply pipes 20 so as to precisely control the amount of slurry. However, it is troublesome to control each of the electromagnetic valves. Further, production cost must be increased.

SUMMARY OF THE INVENTION

The present invention was conceived to solve the above described problems.

An object of the present invention is to provide a double face polishing apparatus, which is capable of controlling an amount of supplying slurry to a lower polishing plate with a simple structure.

To achieve the object, the present invention has following structures.

Namely, the double face polishing apparatus of the present invention comprises:

a lower polishing plate having an upper face, which acts as a polishing face;

an upper polishing plate having a lower face, which acts as a polishing face, the upper polishing plate being provided above the lower polishing plate and capable of moving in the vertical direction;

a carrier being provided between the lower polishing plate and the upper polishing plate, the carrier having a through-hole for holding a workpiece;

a plate driving unit for rotating the lower polishing plate and the upper polishing plate about their axes;

a carrier driving unit for rotating the carrier;

a plurality of ring-shaped ducts being coaxially provided to the upper polishing plate;

a slurry supply source supplying slurry to the ring-shaped ducts; and a plurality of supply pipes communicating slurry supply holes of the ring-shaped ducts to slurry supply holes of the upper polishing plate so as to supply the slurry to the polishing face of the lower polishing plate via the slurry supply holes, the lower polishing plate, the upper polishing plate and the carrier are rotated, with supplying the slurry to the lower polishing plate, so as to polish the both faces of the workpiece, and the slurry is supplied to each of coaxial polishing zones of the lower polishing plate via the corresponding ring-shaped ducts and the supply pipes.

The apparatus may further comprise a flow control valve for adjusting amounts of the slurry supplied to the ring-shaped ducts from the slurry supply source.

In the apparatus, a plurality of the slurry supply sources may respectively supply the slurry to the ring-shaped ducts.

The apparatus may further comprise a temperature adjusting unit for adjusting temperature of the slurry supplied by at least one of the slurry supply sources.

In the double face polishing apparatus of the present invention, a plurality of the ring-shaped ducts are coaxially provided to the upper polishing plate, and the slurry is supplied to each of the coaxial polishing zones of the lower polishing plate via the corresponding ring-shaped ducts and the supply pipes. With this structure, lengths of the supply pipes can be shortened, variation of the lengths can be restrained, and flow resistance of the supply pipes can be reduced. Therefore, the slurry hardly stays in the supply pipes, and the amount of the slurry to be supplied can be easily controlled.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
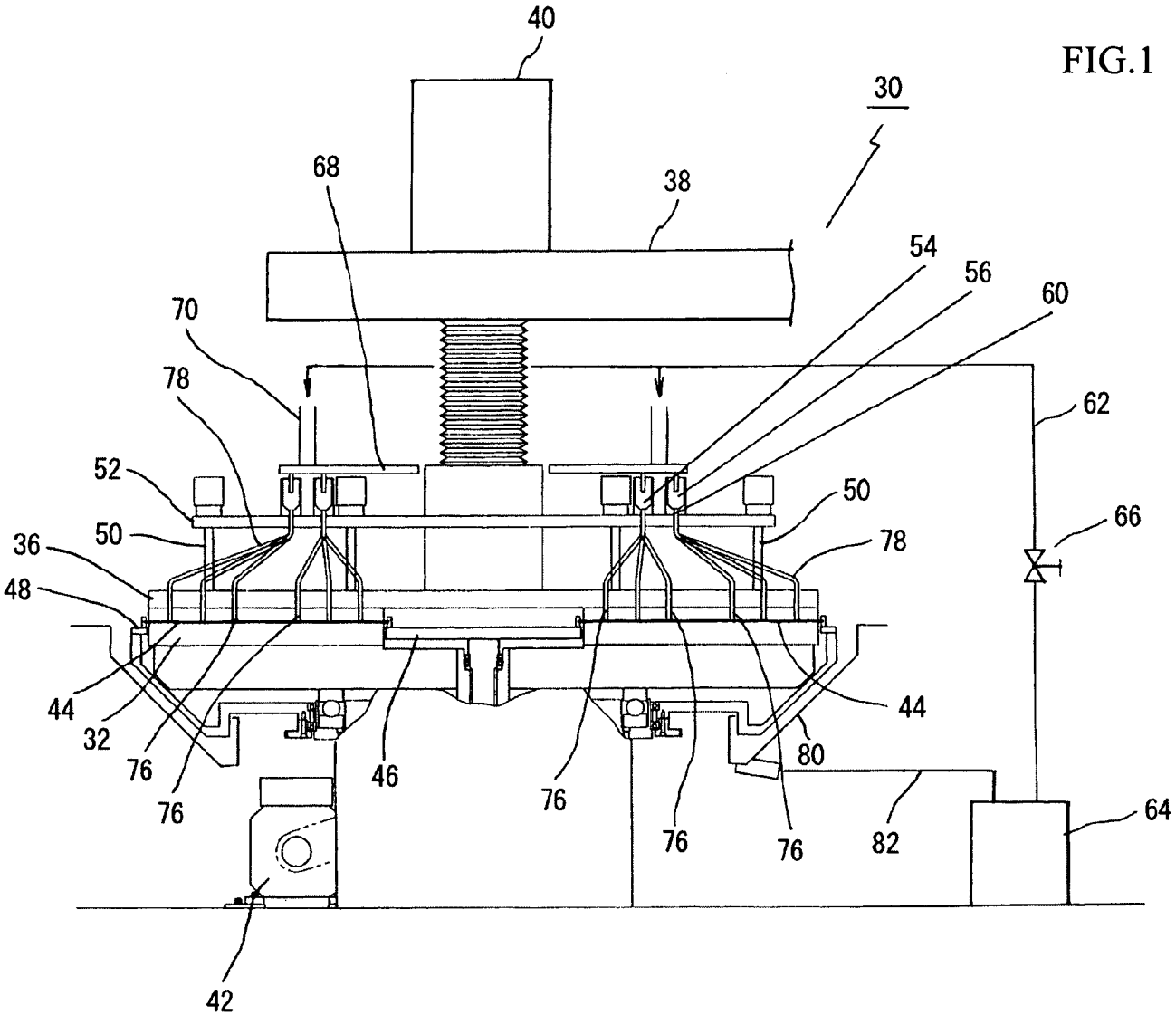
FIG. 1 is an explanation view of a first embodiment of the double face polishing apparatus of the present invention.

FIG. 1 is a front explanation view of a first embodiment of a double face polishing apparatus 30. The polishing apparatus 30 has a known basic structure, so it will be briefly explained.

The polishing apparatus 30 has a lower polishing plate 32, whose upper face acts as a polishing face, and an upper polishing plate 36, whose lower face acts as a polishing face and which is provided above the lower polishing plate 32 and capable of moving in the vertical direction.

The polishing plates 32 and 36 are rotated, about their own axes, in the opposite directions by a plate driving unit 40, 42. The upper polishing plate 36 is rotated about its own axis and moved in the vertical direction by the plate driving unit 40, which is mounted on a base 38. The plate driving unit 40 includes a vertical drive mechanism (not shown), e.g., cylinder unit, and a rotary drive mechanism (not shown), e.g., motor.

A motor (a plate driving unit) 42 rotates the lower polishing plate 32.

Figure 2:
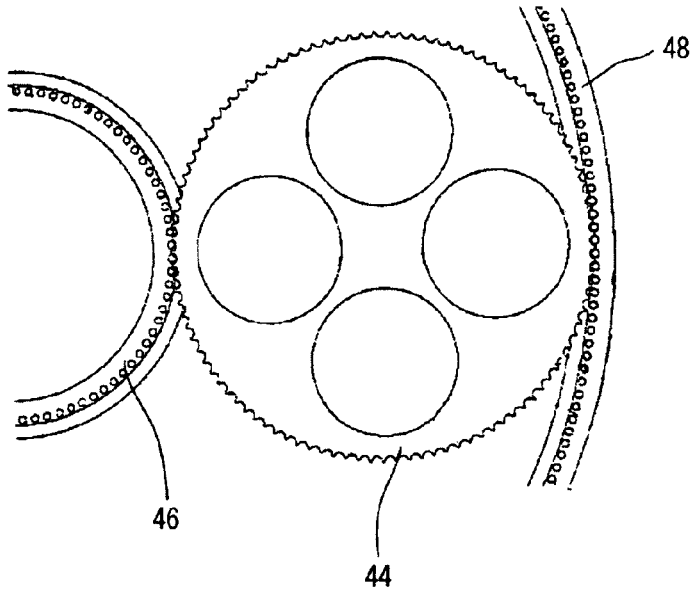
FIG. 2 is an explanation view of a carrier.

Carriers 44, each of which has through-holes for holding workpieces, are provided between the lower polishing plate 32 and the upper polishing plate 36. As shown in FIG. 2, the carriers 44 are rotated about their own axes and orbited by a sun gear 46, which is an inner pin gear provided in a center hole of the lower polishing plate 32, and an internal gear 48, which is an outer pin gear. The sun gear 46 and the internal gear 48 are rotated by a known mechanism or mechanisms.

A rotary plate 52 is attached on the upper polishing plate 36 by supporting rods 50 and rotated together with the upper polishing plate 36.

A plurality of ring-shaped ducts 54 and 56 are coaxially fixed on the rotary plate 52. In the present embodiment, two ducts are coaxially provided.

Slurry supply holes 60 are formed in bottom faces of the ring-shaped ducts 54 and 56.

Slurry is supplied from a slurry supply source 64 to the ring-shaped ducts 54 and 56 via a pipe 62. A flow control valve 66 is provided to the pipe 62.

Figure 3:
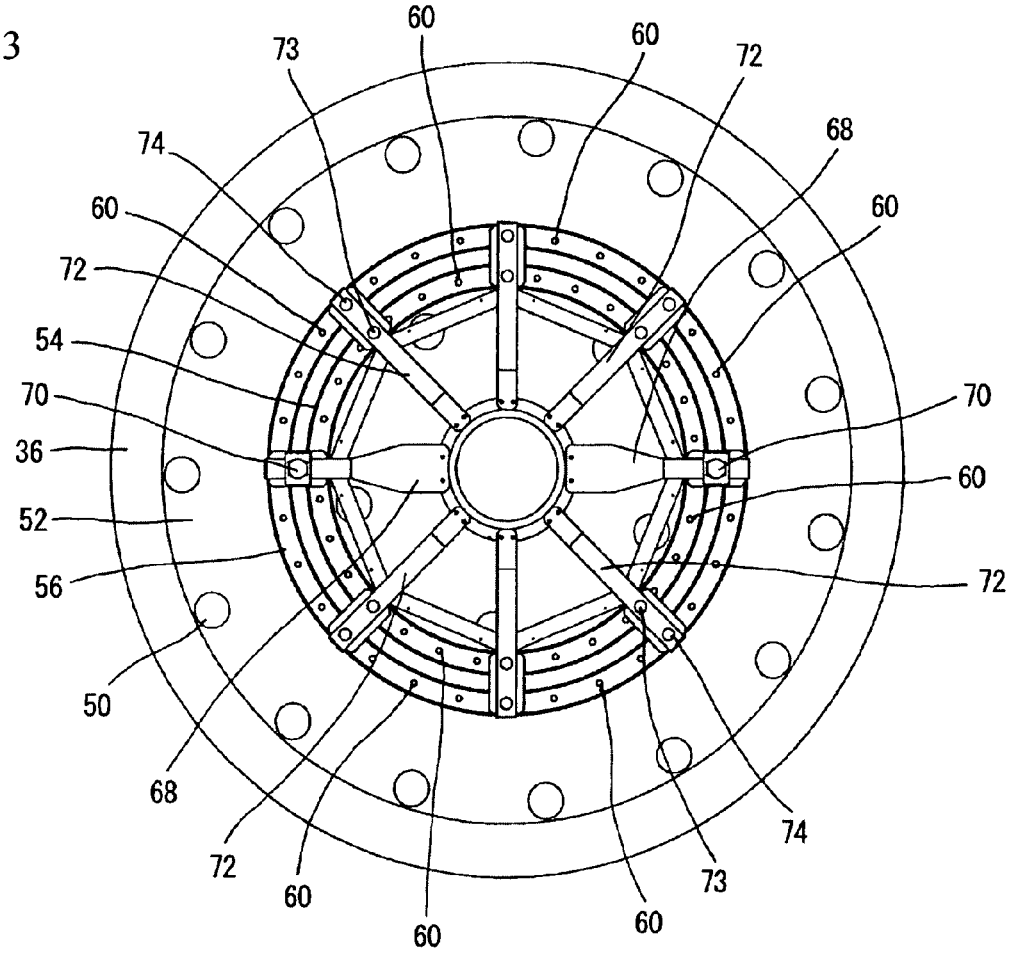
FIG. 3 is an explanation view of ring-shaped ducts.

Firstly, the slurry is supplied from the pipe 62 to receive pipes 70, which are vertically extended from arms 68 (see FIG. 3). The slurry is supplied from the receive pipes 70 to the ring-shaped ducts 54 and 56 via distributing tubes (not shown).

The arms 68 and support arms 72 are supported on the base 38 by known supporting means (not shown).

Figure 4:
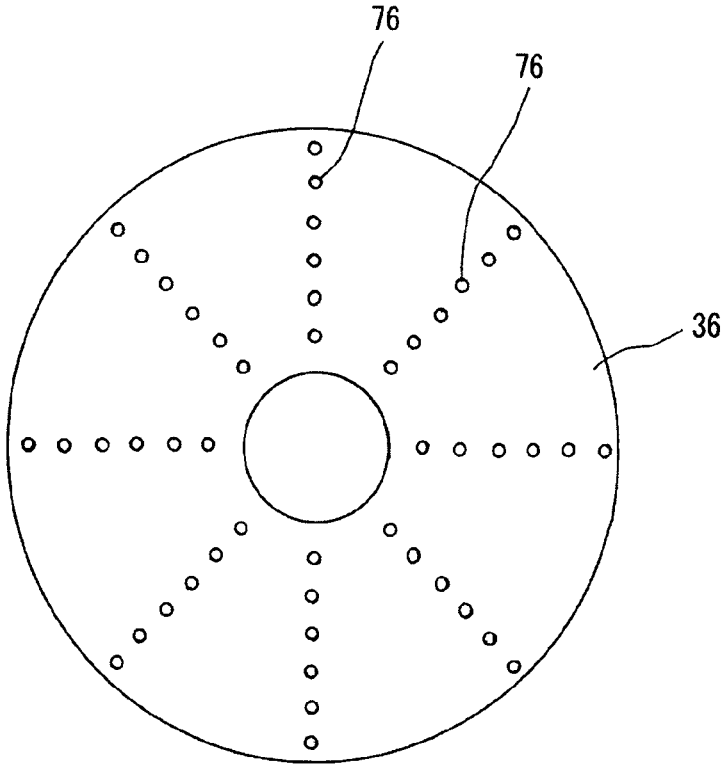
FIG. 4 is an explanation view of slurry supply holes of an upper polishing plate.

Slurry supply holes 76 are radially formed in the upper polishing plate 36 (see FIG. 4). The slurry supply holes 76 of the upper polishing plate 36 are communicated to the slurry supply holes 60 of the ring-shaped ducts 54 and 56 by supply pipes 78. With this structure, the slurry can be supplied to the polishing face of the lower polishing plate 32 via the supply pipes 78.

The slurry is supplied to three of the slurry supply holes 76, which are located in an inner part of the upper polishing plate 36, from the inner duct 54, so that the slurry can be supplied to an inner polishing zone of the polishing face of the lower polishing plate 32.

On the other hand, the slurry is supplied to another three of the slurry supply holes 76, which are located in an outer part of the upper polishing plate 36, from the outer duct 56, so that the slurry can be supplied to an outer polishing zone of the polishing face of the lower polishing plate 32.

The used slurry, which has fallen from the lower polishing plate 32, is returned to the slurry supply source 64 via a recovery duct 80 and a return pipe 82 so as to reuse.

In the above described double face polishing apparatus, the lower polishing plate 32, the upper polishing plate 36 and the carriers 44 are rotated, with supplying the slurry to the lower polishing plate 32, so as to polish the both faces of each workpiece clamped between the polishing plates 32 and 36.

While polishing the workpieces, the slurry is supplied from the inner duct 54 to the inner polishing zone of the lower polishing plate 32 via the supply pipes 78; the slurry is supplied from the outer duct 56 to the outer polishing zone of the lower polishing plate 32 via the supply pipes 78. Unlike the conventional polishing apparatus in which the slurry is supplied from one duct via the supply pipes, lengths of the supply pipes 78 can be shortened, variation of the lengths thereof can be restrained, flow resistance therein can be reduced and the slurry hardly stays therein, so that an amount of supplying the slurry can be easily controlled.

Namely, the slurry can be uniformly supplied to the supply pipes 78 and the amount of the slurry can be controlled by the flow control valve 66, so that the amount of supplying the slurry can be easily controlled.

In the above described embodiment, two ring-shaped ducts 54 and 56 are coaxially provided, but number of the ducts is not limited to two. Three or more ring-shaped ducts may be coaxially provided. In this case, three or more polishing zones are formed in the lower polishing plate 32, and the slurry is supplied to each of the polishing zones from the corresponding ring-shaped duct via the supply pipes 78.

In the above described embodiment, three slurry supply holes 76 correspond to the inner polishing zone of the lower polishing plate 32 and another three slurry supply holes 76 correspond to the outer polishing zone thereof, but number of the slurry supply holes 76 corresponding to each of the polishing zones is not limited to three.

Figure 5:
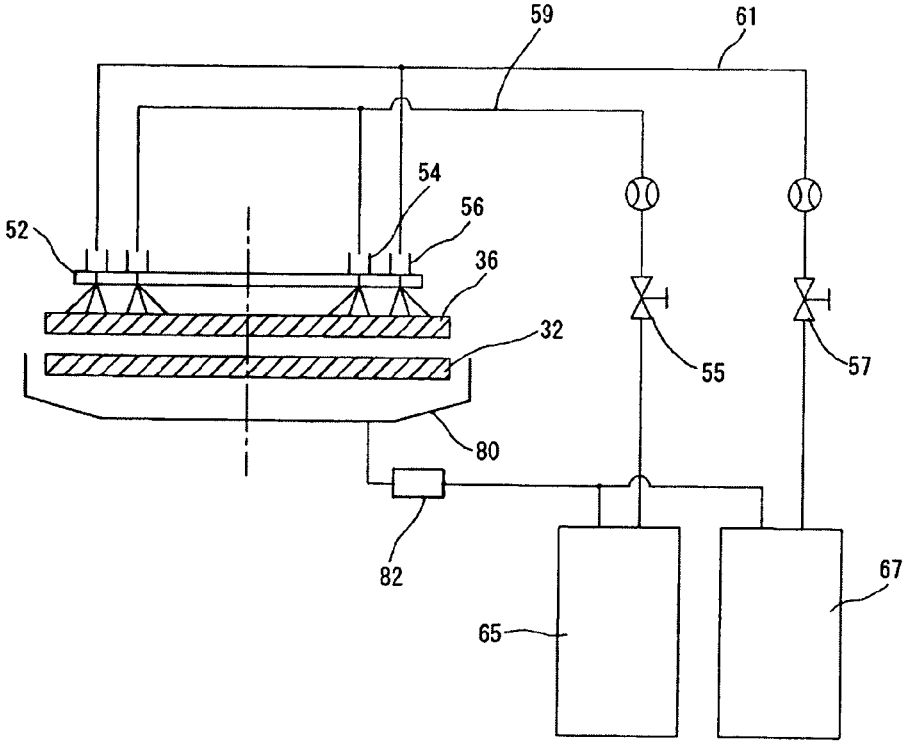
FIG. 5 is an explanation view of a second embodiment of the double face polishing apparatus.
Figure 6:
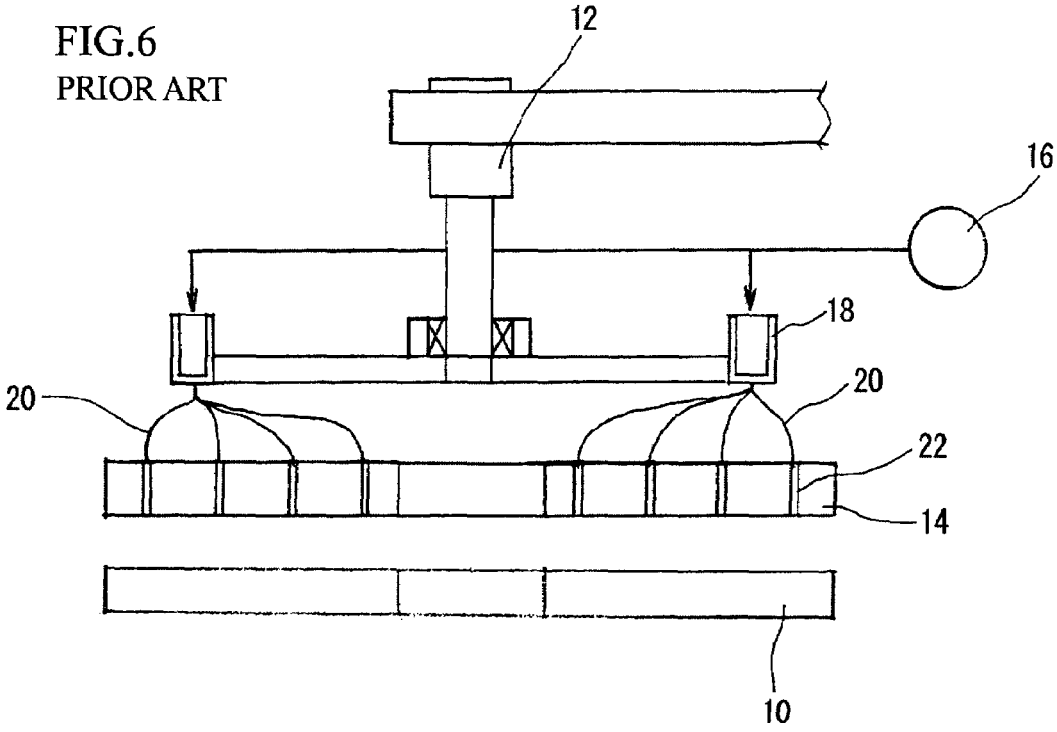
FIG.6 PRIOR ART
FIG. 6 is an explanation view of the conventional double face polishing apparatus.

A second embodiment of the double face polishing apparatus of the present invention will be explained with reference to FIG. 5.

In the second embodiment, number of the slurry supply sources, e.g., two, is equal to that of the ring-shaped ducts. For example, as shown in FIG. 5, two slurry supply sources 65 and 67 are provided. The slurry supply source 65 supplies the slurry to the ring-shaped duct 54 via a pipe 59; the slurry supply source 67 supplies the slurry to the ring-shaped duct 56 via a pipe 61. Flow control valves 55 and 57 are respectively provided to the pipes 59 and 61.

In the present embodiment, the flow control valves 55 and 57 are capable of controlling the amounts of supplying the slurry to the ring-shaped ducts 54 and 56. Therefore, the amount of the slurry supplied to each polishing zone of the lower polishing plate 32 can be easily controlled.

Preferably, a temperature adjusting unit (not shown), which is capable of adjusting temperature of the slurry, is provided to at least one of the slurry supply sources 65 and 67.

The temperature of the slurry will be increased by polishing the workpieces. If the temperature is increased, mechanical and chemical polishing rate is increased. By increasing the polishing rate, the workpieces cannot be uniformly polished in each of the polishing zones. By adjusting the temperature of the slurry, the polishing rates can be equalized in each of the polishing zones.

In the above described embodiments, the carriers 44 are rotated and orbited by the sun gear 46 and the internal gear 48. Further, the carriers 44 may be connected to a carrier holder (not shown), and the carrier holder may be orbited, without rotating about its own axis, by a proper mechanism, e.g., crank mechanism.

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A double face polishing apparatus, comprising:

a lower polishing plate having an upper face, which acts as a polishing face;

an upper polishing plate having a lower face, which acts as a polishing face, said upper polishing plate being provided above said lower polishing plate and capable of moving in the vertical direction;

a carrier being provided between said lower polishing plate and said upper polishing plate, said carrier having a through-hole for holding a workpiece;

a plate driving unit for rotating said lower polishing plate and said upper polishing plate about their axes;

a carrier driving unit for rotating said carrier;

a plurality of ring-shaped ducts being coaxially provided relative to said upper polishing plate;

a slurry supply source supplying slurry to said ring-shaped ducts; and a plurality of supply pipes communicating slurry supply holes of said ring-shaped ducts to slurry supply holes of said upper polishing plate so as to supply the slurry to the polishing face of said lower polishing plate via the slurry supply holes, wherein said lower polishing plate, said upper polishing plate and said carrier are rotated, while supplying the slurry to said lower polishing plate, so as to polish both faces of the workpiece, and the slurry is supplied to each of coaxial polishing zones of said lower polishing plate via said corresponding ring-shaped ducts and said supply pipes.

2. The apparatus according to claim 1, further comprising a flow control valve for adjusting amounts of the slurry supplied to said ring-shaped ducts from said slurry supply source.

3. The apparatus according to claim 2, wherein a plurality of said slurry supply sources respectively supply the slurry to said ring-shaped ducts.

4. The apparatus according to claim 3, further comprising a temperature adjusting unit for adjusting temperature of the slurry supplied by at least one of said slurry supply sources.

5. The apparatus according to claim 1, wherein a plurality of said slurry supply sources respectively supply the slurry to said ring-shaped ducts.

6. The apparatus according to claim 5, further comprising a temperature adjusting unit for adjusting temperature of the slurry supplied by at least one of said slurry supply sources.

* * * * *